US007715583B2

(12) United States Patent
Van Halteren et al.

(10) Patent No.: US 7,715,583 B2
(45) Date of Patent: May 11, 2010

(54) MICROPHONE ASSEMBLY

(75) Inventors: Aart Zeger Van Halteren, Hobrede (NL); Pirmin Rombach, Lyngby (DK); Martin Bondo Jørgensen, Værløse (DK)

(73) Assignee: Sonion Nederland B.V., Amsterdam (NL)

( * ) Notice: Subject to any disclaimer, the term of this patent is extended or adjusted under 35 U.S.C. 154(b) by 593 days.

(21) Appl. No.: 11/231,170

(22) Filed: Sep. 20, 2005

(65) Prior Publication Data

US 2006/0067554 A1 Mar. 30, 2006

Related U.S. Application Data

(60) Provisional application No. 60/610,953, filed on Sep. 20, 2004.

(51) Int. Cl.
*H04R 9/08* (2006.01)

(52) U.S. Cl. ..... 381/361; 381/355; 381/360

(58) Field of Classification Search ..... 381/355–357, 381/369, 174, 318, 335, 360–361, 368, 169, 381/173, 175

See application file for complete search history.

(56) References Cited

U.S. PATENT DOCUMENTS

| | | | | |
|---|---|---|---|---|
| 3,777,079 | A * | 12/1973 | Fischer et al. | 381/357 |
| 4,803,724 | A * | 2/1989 | Utoh et al. | 381/355 |
| 4,815,560 | A * | 3/1989 | Madaffari | 181/158 |
| 4,837,833 | A * | 6/1989 | Madaffari | 381/322 |
| 5,740,261 | A * | 4/1998 | Loeppert et al. | 381/355 |
| 5,870,482 | A * | 2/1999 | Loeppert et al. | 381/174 |
| 6,522,762 | B1 * | 2/2003 | Mullenborn et al. | 381/174 |
| 6,535,460 | B2 * | 3/2003 | Loeppert et al. | 367/181 |
| 6,732,588 | B1 * | 5/2004 | Mullenborn et al. | 73/715 |
| 7,080,442 | B2 * | 7/2006 | Kawamura et al. | 29/594 |
| 7,146,016 | B2 * | 12/2006 | Pedersen | 381/175 |
| 7,466,834 | B2 * | 12/2008 | Ogura et al. | 381/174 |
| 2002/0041694 | A1 * | 4/2002 | Michiels | 381/190 |

(Continued)

FOREIGN PATENT DOCUMENTS

WO WO 00/62580 10/2000

(Continued)

OTHER PUBLICATIONS

Pedersen, Michael; "High-Performance Condenser Microphone with Fully Integrated CMOS Amplifier and DC—DC Voltage Converter"; Dec. 1998; Journal of Microelectromechanical Systems, vol. 7, No. 4; pp. 387-394.*

(Continued)

*Primary Examiner*—Curtis Kuntz
*Assistant Examiner*—Ryan C Robinson
(74) *Attorney, Agent, or Firm*—Nixon Peabody LLP

(57) ABSTRACT

A microphone assembly comprising a housing in which a transducer element is positioned. In the housing, an upper and a lower chamber are defined, the lower chamber extending at least at one edge of the transducer element and potentially to an upper side thereof. An element, such as a horse-shoe shaped element or a circular element, is provided for separating the upper side of the transducer element into the upper and lower chambers. The transducer element is fixed using flexible fixing means, and space is provided at one or more sides of the transducer element to take up thermal expansion and retraction of the housing and the transducer element.

10 Claims, 4 Drawing Sheets

U.S. PATENT DOCUMENTS

| | | | | |
|---|---|---|---|---|
| 2002/0071579 | A1* | 6/2002 | Himori et al. | 381/113 |
| 2002/0094101 | A1* | 7/2002 | De Roo et al. | 381/356 |
| 2002/0172384 | A1* | 11/2002 | Takeuchi et al. | 381/175 |
| 2003/0133588 | A1 | 7/2003 | Pedersen | 381/423 |
| 2005/0094832 | A1* | 5/2005 | Song et al. | 381/174 |

FOREIGN PATENT DOCUMENTS

| | | | |
|---|---|---|---|
| WO | WO 0062580 | * | 10/2000 |
| WO | WO 02/45463 | | 6/2002 |

OTHER PUBLICATIONS

Bai, M.S.; "Silicon Micromachined Condenser Microphone Array for Bionic Ears"; Mar. 23, 2004; Proceedings of the 2004 IEEE Internationd Conference on Networking, Sensing & Control; pp. 819-824.*

* cited by examiner

MICROPHONE ASSEMBLY

CROSS REFERENCE TO RELATED APPLICATIONS

This application claims priority to U.S. provisional application Ser. No. 60/610,953, filed on Sep. 20, 2004. The disclosure of the aforementioned provisional application is incorporated by reference in its entirety herein.

FIELD OF THE PRESENT INVENTION

The present invention relates to a microphone assembly and, in particular, to a microphone assembly having a novel manner of fixing a miniature transducer element inside the housing and a novel manner of separating an internal space of the housing into two chambers.

BACKGROUND OF THE PRESENT INVENTION

In microphone assemblies, as those illustrated and described in PCT Publication No. WO 00/62580 and U.S. Pat. No. 5,740,261, a silicon transducer element has dimensions closely fitting the internal dimensions of the housing and is cemented at its edges to the housing. By this arrangement of the silicon transducer element, the inner space of the housing is divided into two chambers, a front chamber and a back chamber, by the transducer element. The cement used for this application is stiff and substantially non-compliant.

SUMMARY OF THE PRESENT INVENTION

According to one embodiment of the present invention, a microphone assembly is disclosed. The microphone assembly comprises a microphone casing and a first internal chamber. The microphone casing comprises an internal surface and has a miniature transducer element disposed therein. The miniature transducer element is bounded by first and second oppositely arranged outer surfaces and a peripheral edge surface. The miniature transducer element comprises a pressure sensitive part. The first internal chamber is delimited by the second outer surface of the miniature transducer element and the internal surface of the microphone casing. The first internal chamber extends around a portion of the peripheral edge surface of the miniature transducer element.

The above summary of the present invention is not intended to represent each embodiment, or every aspect, of the present invention. Additional features and benefits of the present invention are apparent from the detailed description, figures, and claims set forth below.

BRIEF DESCRIPTION OF THE DRAWINGS

In the following, preferred embodiments will be described with reference to the drawing, wherein.

Figure 1:
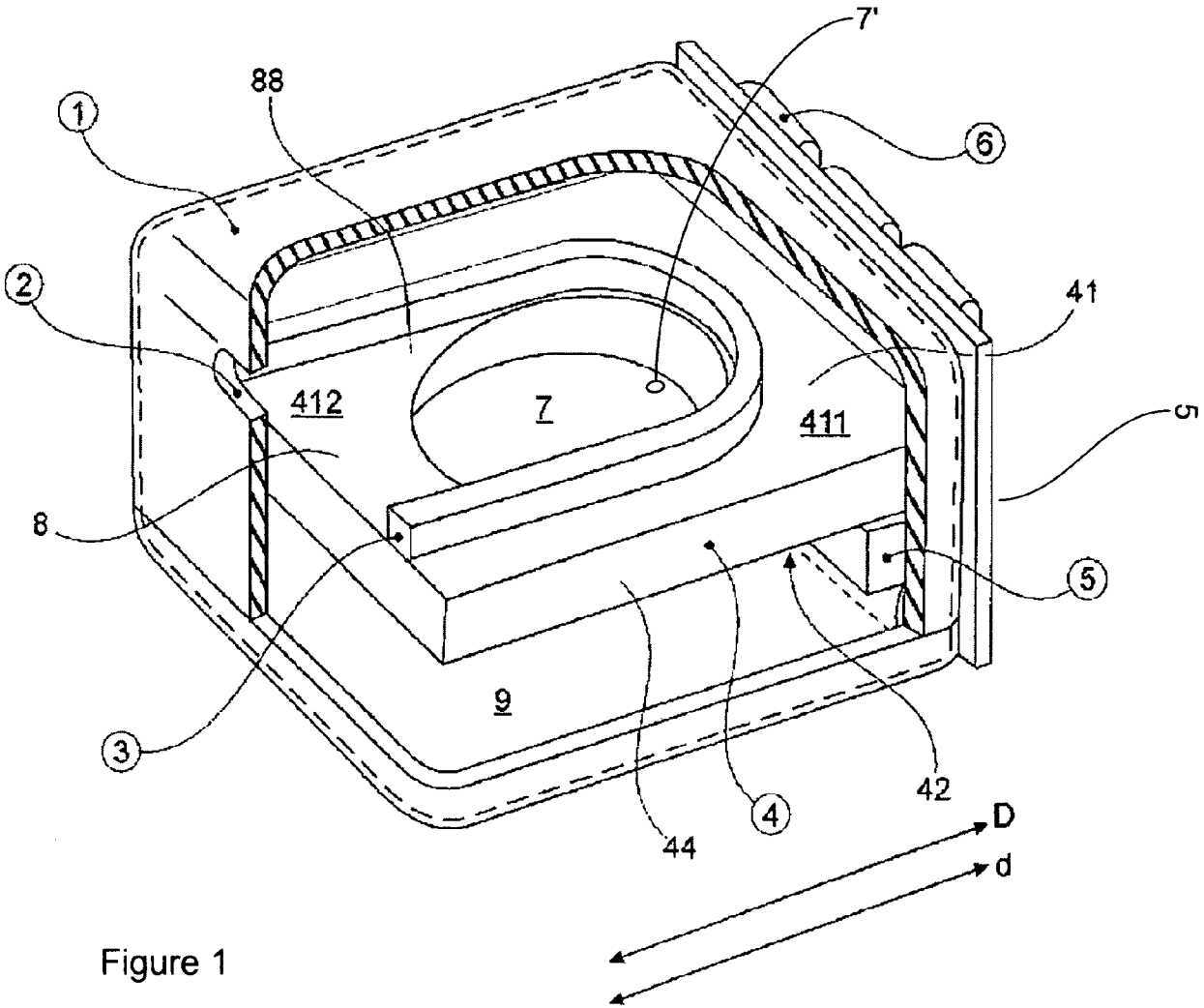
FIG. 1 illustrates a cut away view of a first embodiment of the invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

The present invention relates to at least two significant improvements of a microphone assembly. It has been found that mounting the miniature transducer element in a novel manner facilitates that the volume of the back chamber may be increased by allowing this chamber to extend around a portion of the peripheral edge surface of the miniature transducer element and potentially also the front side thereof. This facilitates a more effective utilization of the internal volume of the microphone casing or housing. A larger back volume of the assembly will give a better noise performance of the microphone assembly. Also, a smaller front volume may maintain the high frequency resonance of the transducer element away from the audible frequency interval.

In addition, it has been found that thermal expansion and retraction of the transducer element and the housing may be so different that the transducer element may be damaged or destroyed with an impaired or altered function as a consequence of no space being allowed between the transducer element and the housing.

In a first aspect, the present invention relates to a microphone assembly comprising a microphone casing and a first internal chamber. The microphone casing comprises an internal surface and has a miniature transducer element disposed therein. The miniature transducer element is bounded by first and second oppositely arranged outer surfaces and a peripheral edge surface. The miniature transducer element comprises a pressure sensitive part. The first internal chamber is delimited by the second outer surface of the miniature transducer element and the internal surface of the microphone casing. The first internal chamber extends around a portion of the peripheral edge surface of the miniature transducer element.

In the present claims and specification, the term miniature transducer element designates a small transducer element such as one having a distance of about 1-20 μm or more preferably about 1-10 μm, such as 1-5 μm, between the diaphragm and back plate, and/or which has an extension, in the plane of the diaphragm, of less than about 4.0 mm×4.0 such as 3.5 mm ×3.5 mm or even more preferably less than 3.0 mm×3.0 mm. Alternatively or additionally, a miniature transducer element comprises a so-called MEMS based transducer element which is a transducer element wholly or at least partly fabricated by application of Micro Mechanical System Technology. The miniature transducer element may comprise a semiconductor material such as Silicon or Gallium Arsenide in combination with conductive and/or isolating materials such as silicon nitride, polycrystalline silicon, silicon oxide, and glass. Alternatively, the miniature transducer element may comprise solely conductive materials such as aluminium, copper, etc., optionally in combination with isolating materials like glass and/or silicon oxide.

In general, the inner space and inner surface of the housing may have any size and shape, depending on the actual application thereof. In order to be useful in existing products, the shape thereof may be desired fixed even though other elements, such as the transducer element, may be made smaller than hitherto. In a preferred embodiment, the existing housing is used in order for the assembly to be used as a drop-in replacement of prior art assemblies. Then, already existing tooling may be re-used while gaining the advantages of the invention.

Normally, the transducer element has a square cross-section, whereby four edges would be provided. This, however, is merely a normal manner and not a requirement in any way.

Compared to the prior art, the first chamber, normally called the back chamber or back volume of the microphone assembly, may be made larger, for the same fixed inner volume, in that space at the side of the transducer element may also be used. This may be obtained by, in a fixed-shape housing, making the transducer element smaller (at least in that dimension) or by changing the dimensions of the housing.

Normally, one side of the pressure sensitive element is connected to the sound inlet. Preferably, this is at the first side of the transducer element. Then, the first chamber is preferably delimited by another side of the pressure sensitive part at the second side of the transducer element.

In this connection, "delimited by" will mean that the pertaining surface(s) take(s) part in the surfaces that combine to define the chamber in question. Additional surfaces may take part in the definition of the chamber, such as surfaces of components or electronics present in the chamber.

Preferably, the assembly further comprises one or more attachment means adapted to attach the first outer surface of the miniature transducer element to the internal surface of the microphone casing in order to maintain the engagement there between. As will become clear further below, the attachment means preferably are flexible, and in one embodiment, comprise a layer of a flexible gluing agent.

In one embodiment, the first outer surface of the miniature transducer element abuts the internal surface of the microphone casing with the flexible gluing agent interposed there between. In this manner, no space need be wasted between the first surface and the internal surface. The flexible gluing agent may have a negligible layer thickness.

In a preferred embodiment, preferably, a distance of at least about 50-1000 μm exists between the portion of the peripheral edge surface of the miniature transducer element and the internal surface. This space may provide room for thermal expansion/retraction of the housing compared to the transducer element in order to not provide stress on the transducer element and the housing, when the temperature changes. In addition, this distance may provide a space increasing the volume of the first chamber. Alternatively, the first chamber may be filled with a resilient material providing acoustic isolation over that edge and/or fixing the transducer element inside the housing. In this embodiment, in fact, a minimum distance of at least 50-1000 μm may exist between each of at least two portions of the peripheral edge surface of the miniature transducer element and the internal surface. Thus, this advantage may be provided by a plurality of the sides of the transducer element. Again, this may be used for both taking up dimension changes and for increasing the volume of the first chamber.

In another preferred embodiment, the first internal chamber extends above a portion of the first surface of the transducer element. Thus, the first chamber may be made even larger.

Then the first chamber extends not only to the side(s) of the transducer element but to the other side thereof. In this manner, the volume of the first chamber may be altered by not only moving the transducer element inside the housing, but also by defining the part of the first surface over which the chamber extends. This gives more degrees of freedom in the positioning and size of the transducer element.

Normally, a second chamber is provided that connects the pressure sensitive element and the sound inlet.

This positioning of the barrier separating the first and the second chamber is novel and has a number of advantages. Firstly, it provides a larger degree of freedom in the definition of the volumes of the first and second chambers as well as the positioning of the transducer element inside the microphone housing.

Secondly, it facilitates both the addition of space at one or more of the sides of the transducer element to the first chamber and the possibility of absorbing dimension changes between the housing and the transducer element at the edges of the transducer element. In fact, it facilitates the dividing of the first surface into the parts/areas comprised in the first and second chambers.

In this connection, it should be noted that the volume of the second chamber may be selected to be very small. It is no longer required that this chamber has a cross-sectional area that is the size of the full transducer element. In fact, as will become clear further below, the volume of the second chamber may be selected to have a cross section corresponding only to that of the sound inlet or the pressure sensitive part, that is, down to a total volume of less than about 1 $mm^3$, such as less than ½ $mm^3$.

In one embodiment, the attachment means have, in a plane of the pressure sensitive part, a horse shoe shaped cross section or a circular cross section. In this connection, the circular cross section may be replaced with any cross section forming a closed curve, such as a square, triangle, oval, or any other closed shape. The horse shoe/circle comprising, within or along its circumference in the plane, both the pressure sensitive part and the sound inlet. The horse shoe/circle defining within its circumference the second chamber, and its outer circumference defining a surface delimiting the first chamber.

In this situation, preferably, the attachment means comprises an acoustical seal between the first internal chamber and a second internal microphone chamber, the second chamber extending above the pressure sensitive part of the miniature transducer element and being acoustically coupled to a sound inlet of the microphone casing. This acoustical seal prevents the short circuiting of the two sides of the diaphragm; at least through the audible frequency range.

In another situation, the miniature transducer element is positioned so that the sound inlet and the pressure sensitive part overlap, in the plane of the pressure sensitive part, and wherein the attachment means encircle, in the plane, the sound inlet and the pressure sensitive part. This may be obtained when the attachment means have, in the plane, a cross section, such as of, for example, a ring, encircling, in the plane, the sound inlet and the pressure sensitive part. Thus, the attachment means form a hollow, closed shape or element that may be circular, round, elliptical, square, or any other shape. Again, the attachment means has within its circumference the second chamber, and its outer circumference defining a surface delimiting the first chamber.

According to a variation of the above embodiment of the invention, a plurality of semiconductor transducer elements, such as 2-4 elements, may be placed adjacent to each other inside the microphone housing and be acoustically connected to a common sound inlet port. The several silicon transducer elements may advantageously be manufactured in a common semiconductor substrate with separate diaphragm and backplate parts.

In general, the microphone assembly preferably further comprises a substantially circular vent or opening acoustically connecting a first side of the pressure sensitive element with another side thereof, the vent or opening having diameter between about 3 and about 100 μm, such between about 3 and 30 μm, or even more preferably, between about 3 and 20 μm. This small or narrow passage or vent may be used as a DC-compensation or vent for equalizing DC pressure differences across the first and second surfaces of the pressure sensitive part. Such pressure differences may be caused by pressure changes in the surrounding environment (moving vertically) or by temperature.

In a preferred embodiment, the transducer element is a MEMS based transducer element manufactured in silicon. This type of transducer element may exhibit a high frequency resonance which is higher than a high frequency resonance of a conventional transducer element. For this type of MEMS based transducer element, it may be desired to keep the second chamber very small—or even as small as possible—in order to avoid downshifting of the high resonance down to the audible frequency domain due to an acoustical mass associated with the second volume and/or the inlet port. Consequently, the present invention is especially well-suited for this type of element.

In general, the present microphone assembly may further comprise one or more electric or electronic components electrically connected to the miniature transducer element. These elements would normally be positioned in the first internal chamber in that this normally is the largest. However, advantages are found in positioning these electric or electronic components in the second internal chamber, in that this would then further increase the effective size of the first internal chamber.

As mentioned above, it is desired that the attachment means also delimit the two chambers inside the housing. Thus, two functions are handled by this element.

The attachment means may be flexible. Thus, the fixing means will be able to both fix the transducer element in the housing and also accommodate the thermal expansion or retraction of the individual elements of the microphone assembly. In this context, "flexible" will mean a Shore A hardness of at the most 65, such as less than 50 or less than 40.

FIG. 1 illustrates a first embodiment of a microphone assembly in accordance with the present invention. The microphone assembly comprises a housing or casing 1 of a metallic material or plastics provided with a metallic coating. A sound inlet or inlet port 2 allows sound to enter and excite a diaphragm 7 of a silicon transducer element 4 positioned within the housing 1.

In the present embodiment of the invention, the silicon transducer element 4 has a rectangular shape with equal side lengths of about 3.1 mm each. The inner side walls of the housing have lengths of about 3.3 mm, which allows the silicon transducer element 4 to be positioned inside the housing 1 with three free edge portions. The three free edge portions do not have any physical contact with the respective opposing inner side wall portions of the housing 1 so as to effectively acoustically couple a housing volume extending above the silicon transducer element 4 and along its peripheral edge portion to a back volume or back chamber 9.

According to a variation of the above embodiment of the invention, a plurality of semiconductor transducer elements such as 2-4 elements may be placed adjacent to each other inside the microphone housing and be acoustically connected to a common sound inlet port. The several silicon transducer elements may advantageously be manufactured in a common semiconductor substrate with separate diaphragm and back plate parts.

An integrated electronic circuit 5 is disposed within the housing 1 that shields the circuit 5 against external electric/magnetic fields. The integrated electronic circuit 5 preferably comprises an ASIC that may comprise a high-impedance and low-noise preamplifier as well as other circuits such as an A/D converter and a DC bias-circuit to provide a bias voltage between the diaphragm 7 and a back plate (not shown) of the silicon transducer element 4. The integrated electronic circuit 5 is preferably connected to the silicon transducer element 4 by means of wire bonding. Electrical connection from the integrated electronic circuit 5 to the outside of the housing 1 is provided through externally accessible terminals 6, such as solder bumps or the like.

The silicon transducer element 4 is fixed inside the housing 1 in a manner so as to abut a horse-shoe shaped element 3 that advantageously may comprise a flexible elastomeric material such as C-flex product No. 170-306-301 manufactured by Consolidated Polymer Technologies, Inc. This horse-shoe shaped element or structure 3 operates to separate an upper and lower side of the diaphragm 7 in a manner so that sound entering the housing 1 is substantially confined to the upper side of the diaphragm 7. Also, the transducer element 4 abuts/engages the housing 1 via the element 3.

In another embodiment of the invention, the horse-shoe shaped element 3 is provided as a separate metallic element, or formed integrally with an internal metallic side wall of the housing 1, and glued to the silicon transducer element 4 using a curable dielectric flexible gel such as product No. 3-6679 dielectric gel manufactured by Dow Corning.

Other alternatives adhesives are product No. 3145 RTV adhesive sealant manufactured by Dow Corning. The adhesive may be processed so as to posses a Shore A hardness of about 33 after 7 days of curing at 25 degrees C. Yet another well-suited adhesive is a Dow Corning Silicone Adhesive Q5-8401, which has Shore A hardness of 61 after curing.

The application of a flexible interconnection layer or interface between the horse-shoe shaped element 3 and the silicon transducer element 4 is able to compensate or absorb differences in thermal coefficients of expansion between the silicon transducer element 4 and the housing.

Consequently, an inner volume of the housing 1 is divided into two separate chambers: a front volume 8, connecting the sound inlet 2 to one side of the diaphragm 7, and the back chamber 9 (e.g., a lower space or back volume) connected to the other side of the diaphragm 7 by a cooperating function of the horse-shoe shaped element 3 and the transducer element 4.

In this situation, the transducer element 4 abuts the housing 1 (or any opening there between is closed) at the surface thereof having the inlet 2 in order to prevent sound from reaching the side via an opening between the housing 1 and the transducer element 4 at the opening of the horse shoe.

The transducer element 4 has a first surface 41 facing up in FIG. 1 and a second surface 42 facing down. It is seen that the horse-shoe shaped element 3 facilitates sound transmission from the sound inlet 2 to the upper side of diaphragm 7 while preventing sound transmission from the sound inlet 2 to the second surface 42 of the transducer element 4, as well as parts 411 of the first surface 41 positioned outside the element 3. Consequently, the back chamber 9 effectively extends around one or more peripheral edge portions 44 of the transducer element 4 and above the first surface 41 thereof into an upper volume 88 of the back chamber 9.

The element 3 may naturally have many other shapes than the horse-shoe shape utilized in this exemplary embodiment, such as rectangular, circular, straight, or any arbitrary shape.

Another advantage of the distance between the peripheral edge portions 44 and the housing 1 is described further below in relation to an improved capability of the microphone assembly to withstand temperature variations that might otherwise cause stress and malfunction of the transducer element 4.

A small acoustical passage 7' is provided between the back chamber 9 and the front volume 8 in order to equalize static pressure differences there between. This passage may be provided through the transducer element 4, and/or through diaphragm 7, and comprise a circular aperture with a diameter between about 3 and 100 μm.

Figure 2:
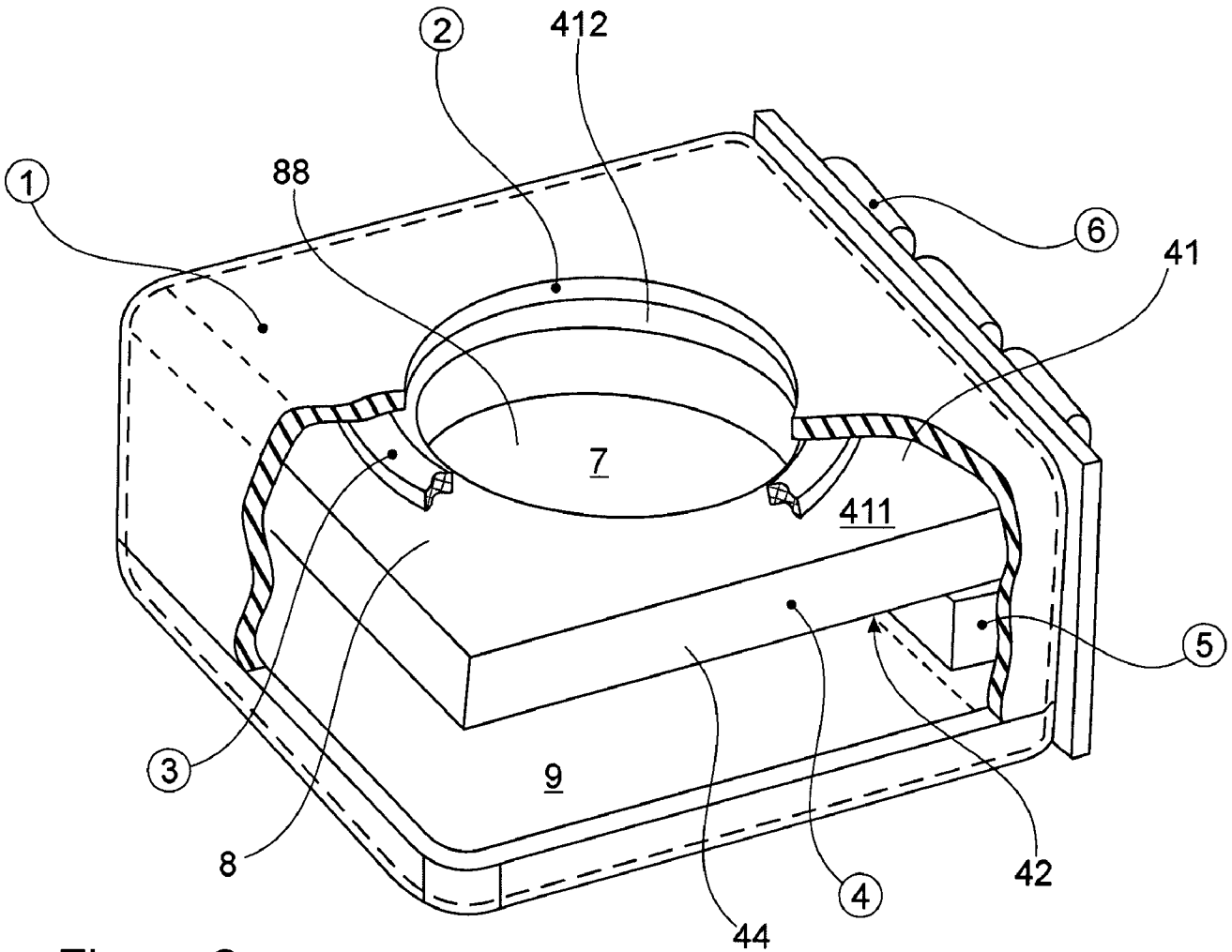
FIG. 2 illustrates a cut away view of a second embodiment of the invention.

FIG. 2 illustrates another embodiment also comprising the housing 1, the sound inlet 2, which is now positioned directly over the diaphragm 7, the transducer element 4, and the sealing, fixing, and/or separating element 3, which is now adapted to the shape or circumference of the diaphragm 7 and the opening 2.

It is seen that the front volume 8 is now even smaller than in the first embodiment and the back volume 9 is even larger in that it covers a larger portion of the first (upper) surface 41 of the transducer element 4. The thickness of the element 3 may be very small, whereby the front volume 8 is nearly minimized. In fact, the element 3 may be avoided, whereby the element 4 rests directly on the wall of the housing. Thus, the only front volume 8 provided is that of any opening in the element 4 toward the diaphragm 7 and the actual sound inlet 2. In that embodiment, the back volume 9 does not extend to the first surface 41, but only along one or more peripheral edge portions 44 of the transducer element 4.

The overall function of the element 3 is to divide the front volume 8 and the back chamber 9 in a manner so that the back chamber 9 may be made larger and the front volume 8 may be made smaller. Also, the element 3 may be used for fixing the transducer element 4 inside the housing 1. Thus, the element 3 may be a solid element, such as a layer of cement or a part of the wall of the housing 1, to which the transducer element 4 may be fixed.

Alternatively, a flexible non-adhesive member may be used, such as one made of rubber or silicone. This member may be adapted to engage or grip the housing 1 and the transducer element 4 in order to perform both the separating and the fixing tasks.

Two embodiments illustrating this gripping of an element that may be non-adhering are seen in FIGS. 3*a-b*, in which FIG. 3*a* has a flexible non-adhesive element 3 that engages the transducer element 4 by friction inside an opening 71 toward the diaphragm 7. Alternatively, the transducer element 4 may be glued to the element 3. The element 3 is glued to the housing 1 using a layer of glue 10.

In FIG. 3*b*, the flexible element 3 again has a friction engagement with the opening 71 in the transducer element 4. Also, the shape of the element 3 is one facilitating a gripping around an edge 21 of the sound inlet 2, whereby no adhesives are required in order to obtain both the separating and the fixing tasks.

Another potential function of the element 3 may be seen when the microphone assembly varies in temperature.

Normally, the housing 1 is made of a metal, such as steel, or of a plastic material coated with an electrically conductive agent or substance. Preferably, however, the transducer element 4 is at least partly made of silicon, whereby the thermal expansion coefficients of the housing 1 and the transducer element 4 are different. Thus, temperature variations will cause a difference in dimension variations between the housing 1 and the transducer element 4, whereby stress and malfunction may be induced in the transducer element unless these variations are taken into account.

In the embodiment of FIG. 1, it is clear that stress will occur, if the transducer element 4 was cemented at all four sides to the housing 1. This stress may cause the transducer element 4 to break, whereby the microphone assembly will no longer function.

Figure 3:
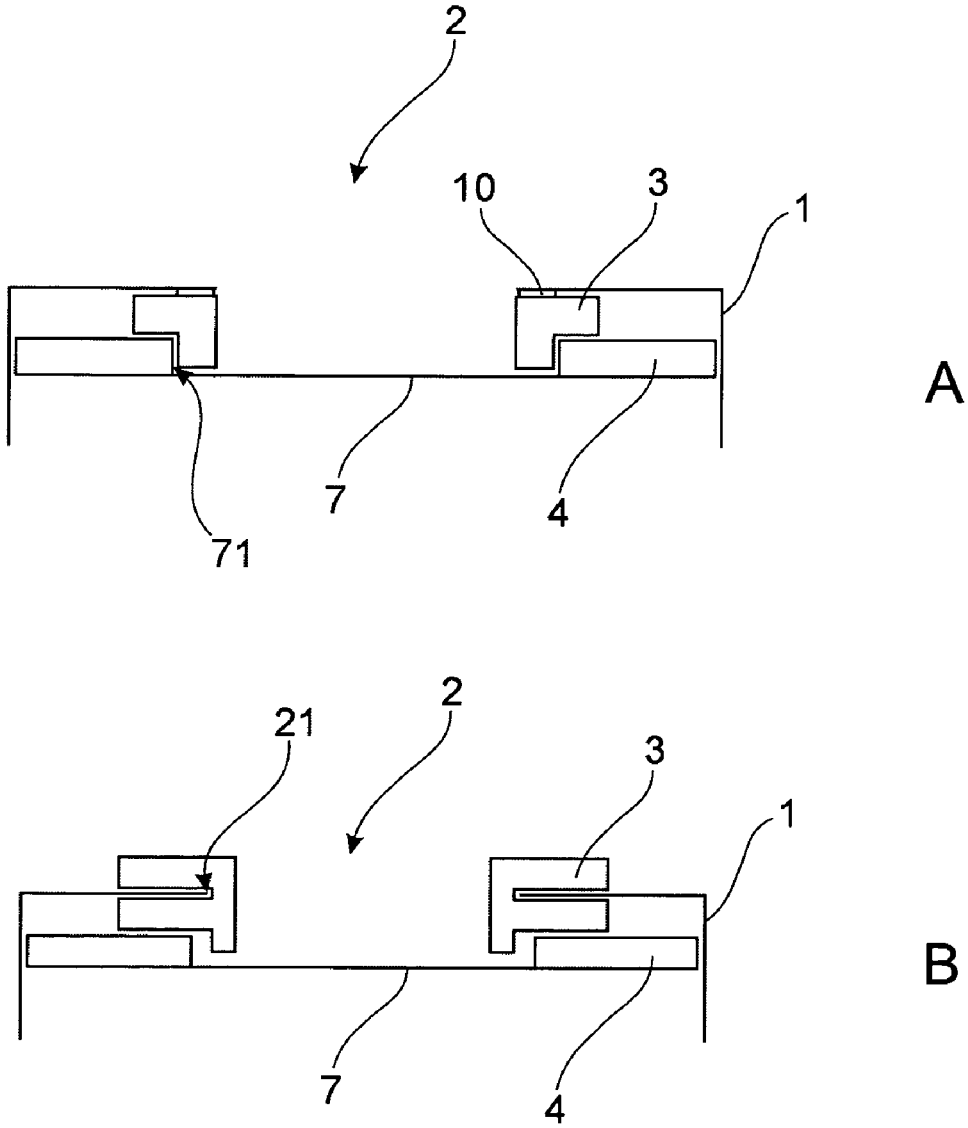
FIGS. 3*a-b* illustrate two other manners of fixing the transducer element inside the housing.

A solution to that problem may be seen in FIGS. 1-3, where the sealing element 3 is resilient or flexible and also fixes the transducer element 4 inside the housing 1.

In addition, in these embodiments, space is provided between the housing 1 and at least most of the peripheral edge portions 44 of the transducer element 4, whereby thermal expansion of one part with respect to the other is no longer a problem.

In general, a distance between the housing 1 and the transducer element 4 is adapted to take up dimension changes.

In FIG. 1, the extent of the transducer element 4 and the housing 1 are illustrated. The inner space of the housing 1 extends a distance D, and the transducer element 4 extends a distance d. The present direction is one in the plane of the diaphragm 7 and normally parallel to the peripheral edge portions 44 of the transducer element 4, which is often square or rectangular. Other directions are, however, equally suitable.

It is seen that the overall space adapted to take up any relative shrinking of the housing 1 and/or dimensional increase of the transducer element 4 is D-d. This space will differ with different temperature and should therefore be chosen large enough to ensure that $d<D$ in the entire temperature interval at which the microphone assembly is to be used. In addition, it may be desired to actually provide D even larger in order to make room for any adhesive to be provided between the element 4 and the housing 1 at that position or along that direction.

In the embodiments of FIGS. 1-3, it is seen that the transducer element 4 may be fixed by contacting only the upper side thereof. When this contact is not around the circumference of the transducer element 4, the demands as to the flexibility of the element 3 may be reduced in that the overall distance interval of which the element 3 must be able to stretch is reduced.

In general, the overall dimensional change of D and d within the temperature interval in question may be denoted C.

This may be seen when comparing the embodiment of FIG. 3 with the situation where the glue or the like is provided along the circumference (peripheral edge portions 44) of the transducer element 4. In the last situation, the adhesive must be able to stretch or be compressed a distance of C/2 in that it is assumed that the transducer element 4 remains centered in the housing 1.

In the embodiment of FIG. 3, the element 3 is only present over a part of the length d of the element 4. Consequently, the overall stretching or compression of the element 3 is a fraction of C, this fraction relating to the relation between d and the extent of the element 3 in the direction. If, e.g., the diaphragm 7 had a diameter of d/2, the element 3 only has to be stretchable or compressible by C/4. Consequently, a less resilient/flexible material may be used compared to the other situation.

The above manner of providing the transducer element 4 preferably comprises providing a self-contained transducer element 4, in that this element will not engage the housing 1 at least at parts of the sides thereof. Also, the transducer element 4 may solely be fixed and held in its predetermined position inside the microphone housing 1 at one surface of the transducer element 4. A transducer element 4, such as a Si-transducer, is well suited for that purpose in that it may be provided as a self-contained unit.

In one embodiment, the transducer element 4 comprises a substantially self-contained MEMS based assembly of transducer element, integrated circuit, and common semiconductor carrier substrate joined for example by flip-chip bonding, as disclosed in U.S. Pat. No. 6,522,762 B1. An aperture may advantageously be provided in the semiconductor carrier substrate to acoustically couple an internal back chamber of the self-contained MEMS based assembly to the back chamber 9 of the microphone housing 1.

Hitherto, however, electric transducer elements have sometimes been provided with the diaphragm provided along the edges thereof with no fixing of the diaphragm. This element is not a self-contained element in the normal sense, whereby it may be desired to actually provide an additional element to this type of element: a means for fixing the diaphragm to the frame of the element in order to ensure that not all sides or all of all sides of the element require fixed abutment with the housing in order to keep the diaphragm in place.

This type of fixing means may be a flexible or rigid band encircling the peripheral edge portions 44 of the transducer element 4, in order to maintain the diaphragm in the desired position.

Figure 4:
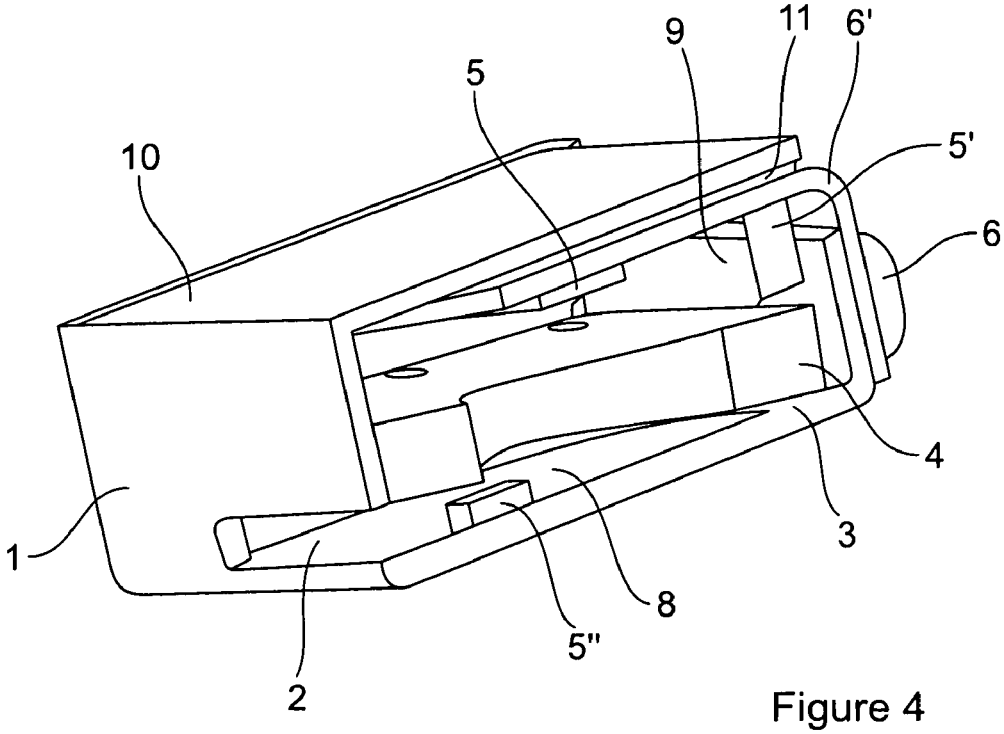
FIG. 4 illustrates a third embodiment of the invention.

FIG. 4 illustrates a third embodiment similar to the first embodiment illustrated in FIG. 1. In FIG. 4, the transducer also comprises a housing 1, a transducer element 4, and a horse-shoe shaped element 3. In this embodiment, however, the transducer element 4 is angled in respect to the position in FIG. 1. The transducer element 4 in FIG. 4 still engages or seals against the housing 1 (such as by engagement or via a sealing/gluing element) at the sound inlet 2 thereof. However, the horse-shoe shaped element 3 has a thickness decreasing in the direction away from the sound inlet 2. In this manner, the back chamber 9 is actually larger than in FIG. 1.

In FIG. 4, the terminals 6 are provided on a flexible or bent element 6', such as a flexible PCB (single sided, double sided, multi-layered) on which the IC 5 and any additional components, such as passive component 5' (e.g., a GSM capacitor), are mounted (e.g., flip chip mounting or bonding wires).

The element 6' may itself close the housing 1, or a lid part 10 may be provided for sealing any openings provided by or in the element 6'. A sealing element 11 may be desired in order to ensure complete sealing there between.

In FIG. 4, the elements 5 and 5' are positioned in the back chamber 9. However, one or more of these elements 5" may alternatively be positioned in the front volume 8.

Figure 5:
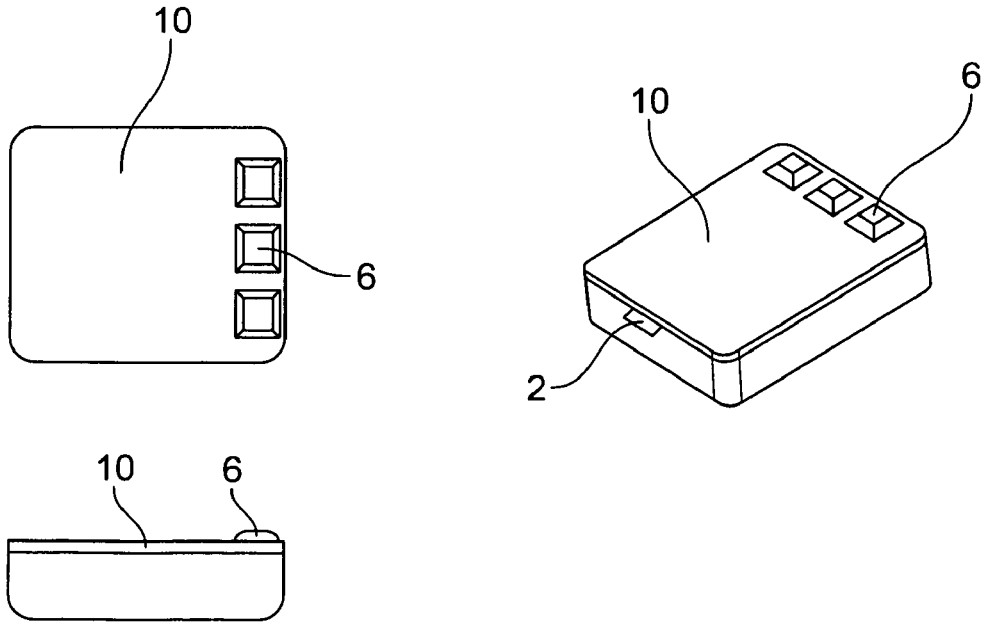
FIG. 5 illustrates a fourth embodiment of the invention.

FIG. 5 illustrates a fourth embodiment seen from the outside. In this embodiment, the housing 1 has a lid 10 having the terminals 6 and being positioned at the inlet 2. This lid 10 may be a ceramic, single or double sided, PCT or a multi-layer PCB to which also the above elements 5 and 5' may be attached and directly electrically connected to the terminals 6.

It is noted that the elements 5 and 5' may then be provided in the front volume (e.g., the sound inlet 2 is positioned adjacently to the lid 10, and still easily connected to the terminals 6).

Another advantage of this embodiment is the positions of the terminals 6. It is seen that this transducer is directly SMD mountable. This is especially so, if the internal elements, the elements 5, 5', and 4, are adapted to withstand the temperatures normally used for SMD mounting. This will be the situation, if the transducer element 4, for example, is a silicon element as was described above.

While the present invention has been described with reference to one or more particular embodiments, those skilled in the art will recognize that many changes may be made thereto without departing from the spirit and scope of the present invention. Each of these embodiments and obvious variations thereof is contemplated as falling within the scope of the claimed invention, which is set forth in the following claims.

The invention claimed is:

1. A microphone assembly comprising:

a microphone casing comprising a sound inlet, an internal surface, and a miniature transducer element disposed in the microphone casing, the miniature transducer element being bounded by first and second oppositely arranged outer surfaces and by a peripheral edge surface, the miniature transducer element comprising a diaphragm acoustically connected to the sound inlet at the first outer surface of the transducer element; and a first internal chamber at least delimited by the second outer surface of the miniature transducer element, a portion of the first outer surface, a portion of the peripheral edge surface, and a portion of the internal surface of the microphone casing that opposes the second outer surface, wherein the first internal chamber extends around the portion of the peripheral edge surface and above a portion of the first outer surface of the miniature transducer element.

2. A microphone assembly according to claim 1, further comprising an attachment means adapted to attach the first outer surface of the miniature transducer element to the internal surface of the microphone casing, the attachment means comprising a layer of a flexible gluing agent.

3. A microphone assembly according to claim 2, wherein the first outer surface of the miniature transducer element abuts the internal surface of the microphone casing with the flexible gluing agent interposed between the first outer surface of the transducer element and the internal surface of the microphone casing.

4. A microphone assembly according to claim 1, wherein a distance of at least 50-1000 μm exists between the portion of the peripheral edge surface of the miniature transducer element and the internal surface of the microphone casing.

5. A microphone assembly according to claim 1, wherein a minimum distance of at least 50-1000 μm exists between each of at least two portions of the peripheral edge surface of the miniature transducer element and the internal surface of the microphone casing.

6. A microphone assembly according to claim 1, comprising one or more attachment means having a horse-shoe shape for abutting the transducer element.

7. A microphone assembly according to claim 6, wherein the one or more attachment means comprises an acoustical seal between the first internal chamber and a second internal microphone chamber, the second internal microphone chamber extending above the diaphragm of the miniature transducer element and being acoustically coupled to a sound inlet of the microphone casing.

8. A microphone assembly according to claim 7, wherein the miniature transducer element is positioned so that the sound inlet and the diaphragm overlap, in the plane of the diaphragm, and wherein the one or more attachment means encircle, in the plane of the diaphragm, the sound inlet and the diaphragm.

9. A microphone assembly according to claim 1, further comprising a substantially circular vent or opening connecting a first side of the diaphragm with another side thereof, the vent or opening having diameter between about 3 and about 100 μm.

10. A microphone assembly according to claim 1, wherein a second internal chamber is delimited by the internal surface of the microphone casing and at least part of the first outer surface, including the diaphragm of the miniature transducer element, the microphone assembly further comprising one or more electric or electronic components electrically connected to the miniature transducer element and being positioned in the second internal chamber.

* * * * *